US008132285B2

(12) United States Patent
Piao

(10) Patent No.: US 8,132,285 B2
(45) Date of Patent: Mar. 13, 2012

(54) BRUSHES WITH RETRACTABLE REMOVABLE HEADS

(75) Inventor: Xianzhen Piao, Tianjin (CN)

(73) Assignee: Anisa International, Inc., Atlanta, GA (US)

( * ) Notice: Subject to any disclaimer, the term of this patent is extended or adjusted under 35 U.S.C. 154(b) by 230 days.

(21) Appl. No.: 12/460,386

(22) Filed: Jul. 17, 2009

(65) Prior Publication Data

US 2010/0017990 A1 Jan. 28, 2010

Related U.S. Application Data

(60) Provisional application No. 61/137,057, filed on Jul. 24, 2008.

(51) Int. Cl.
*A45D 40/26* (2006.01)
*A46B 7/04* (2006.01)
*A46B 17/04* (2006.01)

(52) U.S. Cl. ..... 15/184; 15/169; 15/176.1; 15/202; 132/120; 132/313; 132/317; 132/318

(58) Field of Classification Search ..... 15/168, 15/169, 176.1, 176.6, 184, 194, 202; 132/120, 132/218, 313, 317, 318
See application file for complete search history.

(56) References Cited

U.S. PATENT DOCUMENTS

| | | | | |
|---|---|---|---|---|
| 2,697,642 | A | | 12/1954 | Rudy |
| 2,725,038 | A | | 11/1955 | Owen |
| 2,866,993 | A | | 1/1959 | Edelstone |
| 3,205,523 | A | * | 9/1965 | Seaver ..... 15/184 |
| 3,309,728 | A | * | 3/1967 | Seaver ..... 15/184 |
| 3,363,775 | A | | 1/1968 | Shaw |
| 4,927,281 | A | | 5/1990 | Gueret |
| 5,063,947 | A | | 11/1991 | Gueret |
| 5,107,984 | A | | 4/1992 | Welschoff |
| 5,165,760 | A | | 11/1992 | Gueret |
| 5,339,483 | A | | 8/1994 | Byun |

(Continued)

FOREIGN PATENT DOCUMENTS

CN 201067174 6/2008

(Continued)

OTHER PUBLICATIONS

International Search Report and Written Opinion dated Mar. 26, 2010, PCT Application No. PCT/US2009/004143.

(Continued)

*Primary Examiner* — Mark Spisich
(74) *Attorney, Agent, or Firm* — Alston & Bird LLP

(57) ABSTRACT

One embodiment of an applicator comprises a brush head with a ferrule, and a brush handle. The ferrule has the head at one end and the handle at the other end. Magnetic elements, at least one of which is a magnet, are attached to the brush handle and ferrule where the two parts connect. The brush head can be removed from the handle, assembled with the handle, and switched easily whenever needed. The ferrule can be kept firmly on the handle by the action of the magnet inside. The head can be retracted by sliding a sleeve mounted on the handle forward over the sides of the head. The head, when removed from the handle, can be washed without the risk of water penetrating the sleeve mechanism. The head can also be replaced or interchanged, which can greatly enlarge the versatility of the brush and also avoids waste of material.

9 Claims, 3 Drawing Sheets

U.S. PATENT DOCUMENTS

| | | | | |
|---|---|---|---|---|
| 5,482,059 | A | 1/1996 | Miraglia | |
| 6,035,865 | A | 3/2000 | Krieger | |
| 6,039,052 | A * | 3/2000 | Choi | 132/313 |
| 6,070,597 | A | 6/2000 | Motherhead | |
| 6,189,697 | B1 | 2/2001 | Davis | |
| 6,283,298 | B1 | 9/2001 | Seidler | |
| 6,532,970 | B2 | 3/2003 | Phue | |
| 6,546,937 | B2 | 4/2003 | Gueret | |
| 6,588,958 | B1 | 7/2003 | Seidler | |
| 6,591,842 | B2 | 7/2003 | Gueret | |
| 6,669,389 | B2 | 12/2003 | Gueret | |
| 6,681,936 | B2 | 1/2004 | Godshaw et al. | |
| 6,831,541 | B1 | 12/2004 | Seidler | |
| 6,866,046 | B2 | 3/2005 | Gueret | |
| 6,926,151 | B1 | 8/2005 | Perry et al. | |
| 6,974,513 | B2 | 12/2005 | Kepka | |
| 2001/0037815 | A1 | 11/2001 | Gueret | |
| 2002/0117423 | A1 | 8/2002 | Jackson | |
| 2004/0018037 | A1 | 1/2004 | Gueret | |
| 2004/0168700 | A1 | 9/2004 | Dorf | |
| 2005/0031401 | A1 | 2/2005 | Gueret | |
| 2005/0196220 | A1 * | 9/2005 | Gueret | 401/129 |
| 2005/0224392 | A1 | 10/2005 | Perry et al. | |
| 2007/0014624 | A1 | 1/2007 | Fogelson et al. | |
| 2007/0199575 | A1 | 8/2007 | Del Ponte | |
| 2007/0261188 | A1 * | 11/2007 | Levy et al. | 15/184 |
| 2008/0283083 | A1 | 11/2008 | Piao et al. | |
| 2010/0017990 | A1 | 1/2010 | Piao et al. | |

FOREIGN PATENT DOCUMENTS

| | | |
|---|---|---|
| JP | 57-018414 | 1/1982 |
| JP | 2003-033228 | 2/2003 |
| KR | 20-0432010 | 11/2006 |
| WO | WO 2009/054918 | 4/2009 |
| WO | WO 2010011273 | 1/2010 |

OTHER PUBLICATIONS

Office Action dated Apr. 5, 2010, U.S. Appl. No. 11/975,808.
International Search Report and Written Opinion dated Mar. 26, 2009, Application No. PCT/US2008/011883.
Office Action dated Mar. 24, 2010, U.S. Appl. No. 11/702,475.

* cited by examiner

BRUSHES WITH RETRACTABLE REMOVABLE HEADS

CROSS REFERENCE TO RELATED APPLICATIONS

This application claims benefit of U.S. Provisional Patent Application No. 61/137,057, filed on 24 Jul. 2008 by Xianzhen Piao, which is incorporated herein by reference in its entirety.

This application is related to U.S. patent application Ser. No. 11/975,808, filed 22 Oct. 2007, publication no. US 2008/0283083 A, which is incorporated herein by reference in its entirety.

BACKGROUND

Cosmetic brushes are the main applicators for people applying makeup. Different sorts of makeup require different brushes such as a lip brush, an eye shadow brush etc. In cosmetic applicators currently commercially available, one brush has only one function, so the user needs to buy a set of brushes to achieve a satisfactory makeup application. A brush head on a normal brush can be damaged by frequent use, and may need to be replaced. However, it is wasteful to throw the brush handle and ferrule away when only the head of the brush is damaged.

Commonly assigned U.S. patent application Ser. No. 11/975,808 proposes a brush with interchangeable heads sharing a common handle. In the brush sets proposed in that application, the detached heads are stored in a wallet, with the bristles or other applicator head of each brush exposed. Although care is taken to prevent the heads from rubbing against one another in the wallet, offsetting of cosmetics from one head to another, or damage to the heads, cannot be entirely prevented. The head actually mounted on the handle is even more exposed, because it is typically not stored in the wallet.

Cosmetic brushes are available that include a sleeve. The sleeve can be slid between a retracted position, in which the sleeve effectively becomes part of the handle, and an extended position, in which the sleeve surrounds and protects the brush head. A disadvantage of those "retractable" brushes is that when cleaning the brush head water or other cleaning agents can get into the sleeve mechanism. Water can rust or tarnish metal parts, cause parts of natural material to swell, and otherwise impair the function or appearance of the sleeve mechanism. Even if the water does no actual damage, it can remain trapped in the mechanism, so that next time the sleeve is extended the sleeve is wet, which is unpleasant for the user, and the wetness may combine undesirably with cosmetic powders. In addition, the handle and sleeve mechanism is comparatively expensive, and it is uneconomical to have one such handle and sleeve mechanism for every brush head, which has to be discarded when the head becomes damaged or worn out.

SUMMARY

In accordance with an embodiment of the present invention, there is provided a brush having one or more removable heads. The brush has a sleeve that can be extended, or into which the head can be retracted, to shield the head from its environment and/or to shield the environment from the head when the head is not in use.

In one embodiment of the invention, a brush comprises a brush head, a ferrule, and a brush handle. The brush is assembled with the head at one end of the ferrule, and the handle at the other end of the ferrule. There is a piece of magnet attached to at least one of the brush handle and the ferrule where the two parts connect. The brush further comprises a sleeve captive on either the handle or the ferrule and slidable relative to the brush head between an extended position in which it surrounds the sides of the brush head and a retracted position in which the sleeve leaves the brush head exposed for use.

The sleeve in its retracted position may be retracted at least partly inside a visible outer shroud or body.

The brush may further comprise a cap that fits over the brush head and sleeve when the sleeve is in the extended position. The cap may fit over the sleeve only when the sleeve is in the extended position. Alternatively, the cap may be sufficiently long to fit over the brush head and sleeve when the sleeve is in the retracted position. The cap may then be mounted by extending the sleeve, placing the cap on the sleeve, and retracting the sleeve, thus avoiding the (usually almost insuperable) problem of fitting a cap over a brush head without the lip of the cap catching on the outer bristles.

A single brush handle can be assembled with various brush heads. Once the brush head is damaged, the user can just change the brush head instead of throwing the whole brush away. In addition, this brush can serve various functions in applying makeup by providing various brush heads that are easily assembled onto the brush handle with a magnet.

The brush may be part of a kit comprising different handles that can be used with a single head, or different heads that can be used with a single handle. By interchanging different heads or handles, the user can be provided with the functionality of several different brushes without the cost and size of so many brushes. For example, a single handle with various brush heads can be put into a small cosmetic box or pouch to avoid contamination of the brush heads while at the same time providing a brush set that is convenient to take when traveling.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE DRAWINGS

Reference will now be made in detail to various embodiments of the present brushes, examples of which are illustrated in the accompanying drawings. The embodiments are described by way of explanation, and not by way of limitation.

Figure 7:
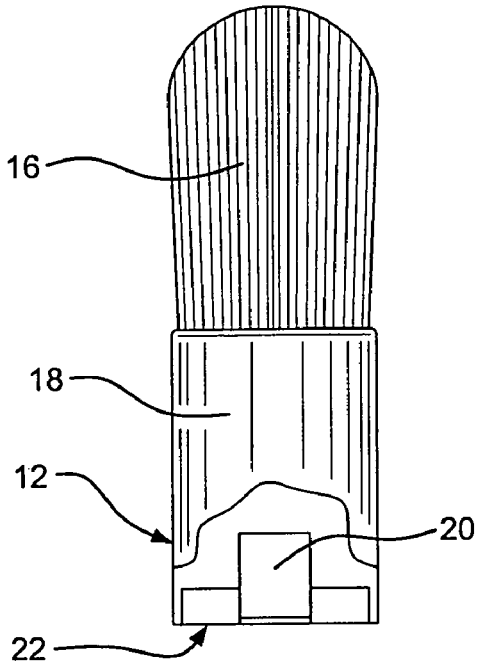
FIG. 7 is a front section view a head of the brush shown in FIG. 1.
Figure 8:
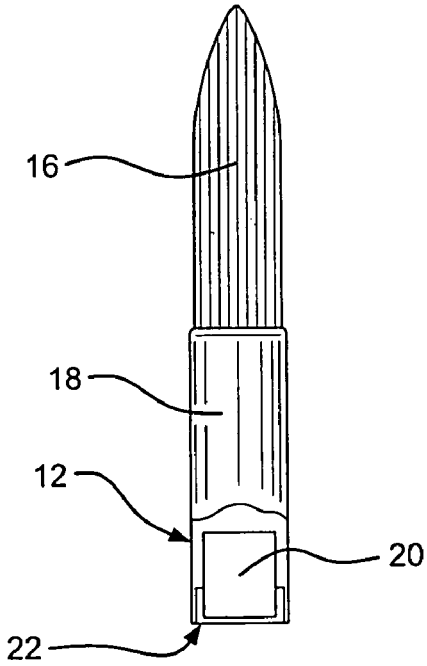
FIG. 8 is a side section view of the head of the brush shown in FIG. 1.
Figure 5:
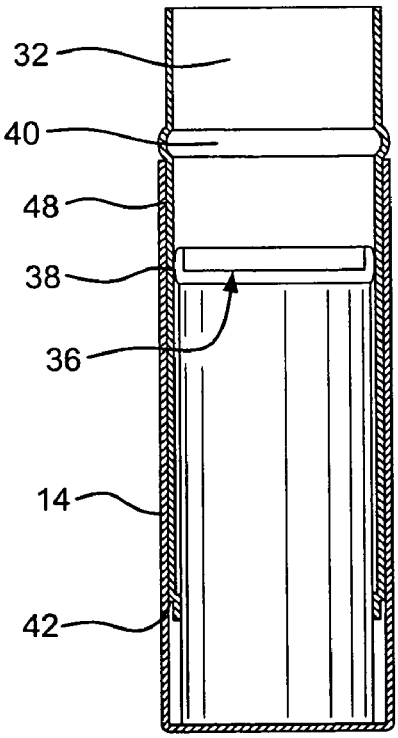
FIG. 5 is a front section view of a handle of the brush shown in FIG. 1.
Figure 6:
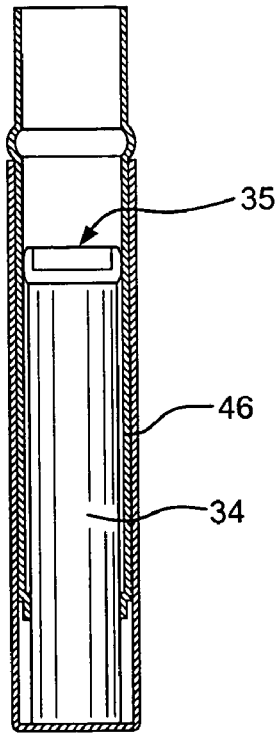
FIG. 6 is a side section view of the handle of the brush shown in FIG. 1.
Figure 9:
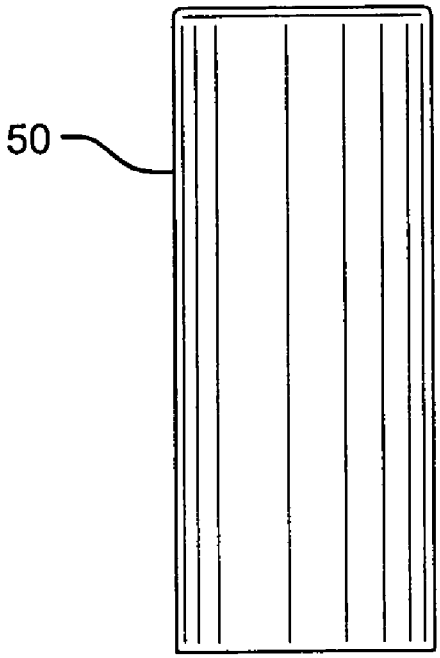
FIG. 9 is a front view of the cap as shown in FIG. 3.
Figure 10:
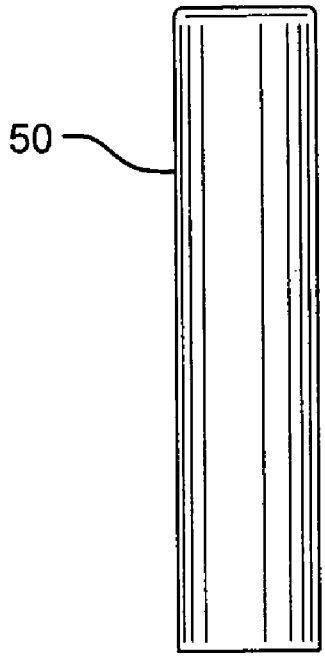
FIG. 10 is a side view of the cap as shown in FIG. 4.

Referring to the drawings, one embodiment of a brush indicated generally by the reference numeral 10 comprises a brush head assembly 12, shown separately in FIGS. 7 and 8, and a brush handle 14, shown separately in FIGS. 5 and 6.

The brush head assembly 12 comprises a head 16 comprising bristles or the like, and a ferrule 18. A first magnetic element, in the form of a first magnet 20, is mounted at the end 22 of the ferrule 18 facing away from the head 16. In the embodiment, the ferrule 18 holds the bristles 16 in a conventional manner, and so that the head 16, ferrule 18, and first magnet 20 form, from the user's point of view, a permanent head assembly 12.

In the embodiment, the ferrule 18 is formed from anodized aluminum or other material with a decorative appearance. Although not shown in detail, the ferrule 18 and the visible surface of the end 22 may be formed in a single cup-shaped piece, or may be separate. In the latter case, the rear edge of the ferrule 18 may form a lip curled in over the end 22, which is generally planar, as shown in FIGS. 7 and 8. The first magnet 20 may be distinctly visible, or may form the entire end 22, or may be covered by a decorative facing.

Figure 11:
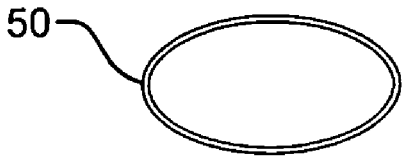
FIG. 11 is a cross-section view of the cap shown in FIGS. 9 and 10.

Referring now especially to FIGS. 5 and 6, the handle 14 comprises a handle body 30 that is sized and shaped for convenient holding by the user. As shown in the drawings, the handle body 30 is cylindrical in the strict mathematical sense. As may be seen from FIG. 11 (which shows the shape of a lid 50, described in more detail below, corresponding to the body 30), the body 30 in this embodiment is an elliptical cylinder, not a circular one. The cross-sectional shape of the body 30 may be determined by the shape of the head 16, which in this embodiment is a foundation brush head. Where heads 16 of different shapes are to be used with a single handle 14, a circle or roundish ellipse may be preferred. As shown in the drawings, the handle body 30 is about 50 mm (2") long and about 19 mm (¾") wide, but other shapes and sizes may be used. For example, a longer handle can be provided, and the part of the handle below (further from the brush head 12 than) the handle 14 shown in the drawings may be of another shape without affecting the function of the brush. The outside of the handle body 30 may have a decorative finish.

A sleeve 32 is fitted within the handle body 30. A core 34 is also fitted within the handle body 30, forming a narrow slot between the core 34 and the inside of the handle body 30 in which the sleeve 32 can slide. The rear end of the core 34 is attached to the rear end of the handle body 30 in any convenient way.

The front end 35 of the core 34 is generally planar, as shown in FIGS. 5 and 6, and has a second magnetic element, in the form of a piece of ferromagnetic material 36, such as magnetically soft iron, that can be attracted by the first magnet 20, to hold the brush head assembly 12 securely in place in the handle assembly 14. As may be seen by comparing FIGS. 1, 5, and 7, the ferrule 18 of the brush head assembly 12 then fits inside a cavity, which is formed in the handle body 30 and defined in part by the sleeve 32, with part but not all of the length of the ferrule 18 inside the handle body 30. The front end 35 of the core 34, which defines a floor of the cavity, is surrounded by a bead 38 that projects outwards.

The sleeve 32 is generally cylindrical, with a cross-sectional shape matching the elliptical or other cross section of the handle body 30. The sleeve 32 has an outwardly projecting ring or bead 40 encircling the sleeve part of the way along its length, and an inwardly projecting lip 42 at its rear end. The parts 44 and 46 of the sleeve 32 above and below the bead 40 do not have to be the same size, but it is convenient if they both receive the ferrule 18 snugly but without binding. As will be explained in more detail below, the lip 42 on the sleeve 32 is sized so that it can move freely in the slot between the handle body 30 and the core 34, but cannot pass the bead 38 on the core.

Figure 1:
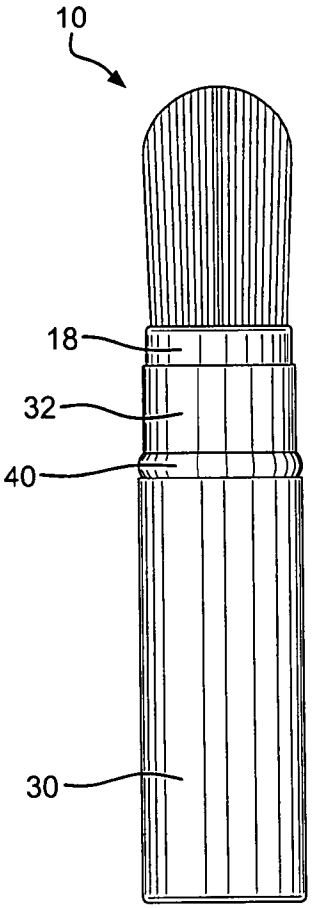
FIG. 1 is a front view of an assembled brush.
Figure 2:
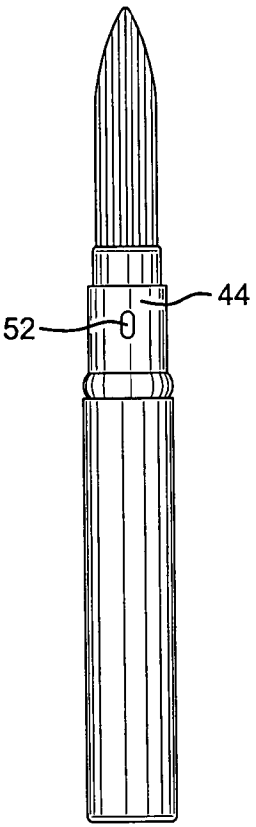
FIG. 2 is a side view of the brush shown in FIG. 1.
Figure 3:
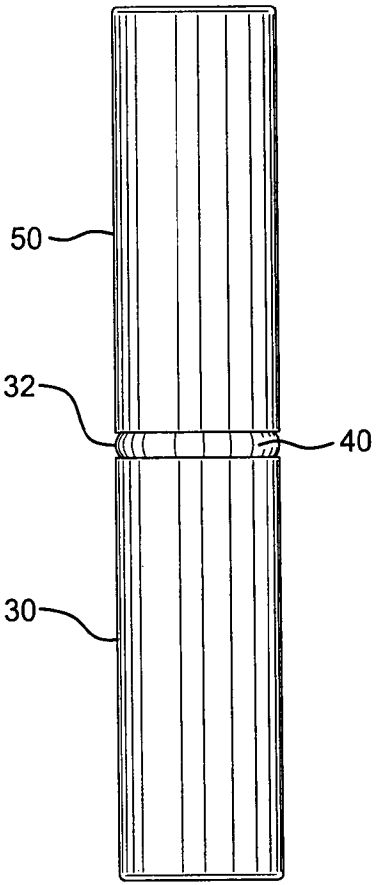
FIG. 3 is a front view of the brush shown in FIG. 1 with a cap.
Figure 4:
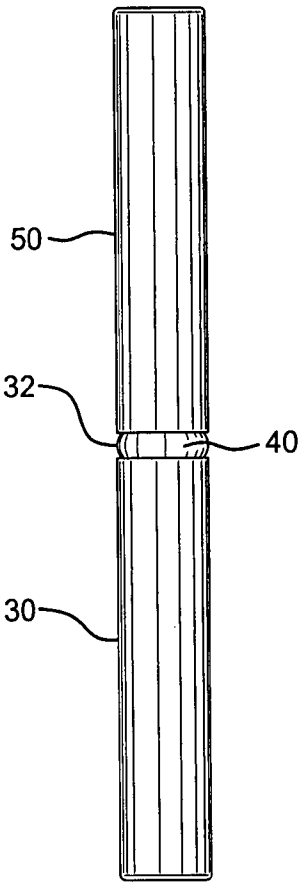
FIG. 4 is a side view of the brush shown in FIG. 3 with the cap.

When the sleeve is in its retracted position, the bead 40 abuts the front end of the handle body 30, stopping further movement of the bead 40 in the retracting direction. In that position, as shown in FIGS. 1 and 2, the front part 44 of the sleeve 32 overlaps part of the ferrule 18. The sleeve 32 should not usually extend beyond the front end of the ferrule 18 and overlap the brush head 16, although it may do so in particular cases. Usually, a sufficient length of the ferrule 18 is left exposed for a user to grip between finger and thumb when removing the head assembly 12 from the handle assembly 14. The external finish of the front part 44 of the sleeve 32 may match that of the ferrule 18, or may contrast with it for decorative effect. A pair of projecting dots 48 on the sleeve 32 just below the bead 40 may provide a force or friction fit inside the handle body 30, holding the sleeve stably in the fully-retracted position.

When the sleeve 32 is in its extended position, the lip 42 at the rear end of the sleeve catches on the bead 38 of the core 34, preventing the sleeve from being pulled completely out of the handle body 30. In the extended position, the sleeve 32 preferably completely surrounds the head 16, so that even the very tip of the head 16 is below the front edge of the sleeve 32. It will be seen that imposes a minimum amount of travel on the sleeve 32, related to the length of the head 16, and thus a minimum length of the handle body 30. However, in some cases with a pointed brush head 16, a sleeve 32 that reaches only part way up the taper would be acceptable.

The brush assembly 10 further comprises a cap 50, see FIGS. 3, 4, and 9 to 11. The cap 50 fits snugly over the front part 44 of the sleeve 32, and is held in place by two projecting dots 52 providing a force or friction fit. The cap 50 seats against the bead 40, and for esthetic appearance may be of the same cross-sectional size as the handle body 30. As may be seen in FIGS. 3 and 4, when the cap is in place, the bead 40 is visible. The bead 40 may be given a decorative appearance, and may be color coded to indicate the type of brush provided, if that is not interchangeable. As shown in the embodiment, the cap 50 is sufficiently long to cover the brush head 16 without the inside of the cap crushing the tip of the head, even when the sleeve 32 is fully retracted.

In use, the brush 10, with the sleeve 32 retracted and the head assembly 12 installed, may be used as a normal cosmetic brush. The head assembly 12 may be removed by gripping the exposed rim of the ferrule 18 or the head 16 (see FIG. 1) between finger and thumb or with a suitable tool, and pulling it away against the attraction between the magnetic elements 20 and 36. The head 16 may then be washed without the handle or sleeve mechanism being exposed to water or other cleaning agents. The head assembly 12 may then be re-installed, or a new head assembly 12 may be installed, simply by inserting into the sleeve 32 until the magnetic attraction between the magnetic elements 20 and 36 takes effect and pulls the head assembly into place.

To protect the brush head 16, the sleeve 32 may be slid forward over the brush head. To expose the brush head 16 for further use, the sleeve may be slid back into the handle body 30. To attach the cap 50, the sleeve 32 is slid forward until at least the outer parts of the brush head 16 are protected. The cap 50 is then fitted onto the sleeve 32, without any risk of the edge of the cap fouling the brush head 16, thereby avoiding, or at least greatly mitigating, the risk of damaging the brush head 16, for example by catching outlying bristles with the lip of the cap 50 and breaking them or bending them out of position. The exposed part of the sleeve 32 below the bead 40 may be grasped to prevent the sleeve from retracting while the cap 50 is being fitted. The cap 50 is then pushed down, causing the sleeve 32 to retract. Alternatively, the cap 50 may be only long enough to cover the front part 44 of the sleeve 32, with the sleeve 32 remaining extended while the cap 50 is in place. In that alternative, an additional pair of projecting dots 48 or other detent to hold the sleeve 32 in the extended position may be provided.

The brush 10 shown in the drawings is described with a first magnet 20 and a second magnetic element 36 that is not permanently magnetized. Alternatively, the second magnetic element 36 may be a magnet, and the first magnetic element 20 may be a piece of magnetizable iron. Alternatively, the first and second magnetic elements 20, 36 may both be permanent magnets. The magnets 20, 36 are then oriented so that they are attracted to each other in the assembled position. For example, the magnets may both be magnetized with their polar directions in the same direction parallel to the axes of the ferrule and the handle core 34. Having only one of the magnetic elements 20, 36 as a permanent magnet, and the other a piece of magnetizable iron, reduces the maximum attachment force obtainable for a given magnetic material and size of brush, but reduces the cost, and avoids the need to ensure that two permanent magnets are aligned in the same direction.

As described in above-mentioned co-pending application Ser. No. 11/975,808, an applicator set may be provided with different head assemblies for different purposes within the overall process of applying make-up. The brushes may have different heads. Suitable heads may include brush heads of various shapes, a sponge applicator, a brush and comb, and other applicators or tools used in the process of applying make-up or otherwise attending to one's personal appearance. It is preferred that all the different head assemblies 12 have ferrules 18 of the same size and shape, to fit snugly within the sleeve 32, at least from the rear end 22 of the ferrule to the front end of the sleeve 32 when the sleeve 32 is retracted. That size and shape then desirably corresponds to the largest head 16 in the set. Forward of the sleeve 32, the ferrules can taper to fit the thinner and narrower heads.

Alternatively, some or all of the head assemblies may have substantially identical heads, but may be used for applying different cosmetic materials, including cosmetic materials of different colors, to avoid contamination of the materials by using the same brush or other applicator for more than one material. Alternatively, some of the brush head assemblies 12 may be of similar shapes but of different materials, for example, one brush may be stiffer than another. In these cases, differently colored ferrules 18 may be particularly helpful to the user if the heads are used interchangeably with a single handle assembly 14, or differently colored beads 40 if the handles are not interchangeable.

Where a cosmetic application kit comprises more than one head 16, whether with a single handle assembly 14 or individual handle assemblies 14, the kit may be kept in a wallet or pouch as discussed in the above mentioned co-pending application Ser. No. 11/975,808.

Various modifications and variations can be made in the present invention without departing from the spirit or scope of the invention. Thus, it is intended that the present invention cover the modifications and variations of this invention provided they come within the scope of the appended claims and their equivalents.

For example, in a brush with interchangeable heads, the sleeve 32 could be mounted on the ferrule, so that each head 16 can be left protected by a sleeve 32 or a cap 50 when the head in question is detached from the handle assembly 14.

For example, the sleeve 32 could be mounted outside the handle body 30, instead of inside.

For example, two or more interchangeable handles 14, which may be the same or different, may be provided in one kit. Alternatively, a single head may be used with different handles, for example, to allow different manners of using the single head.

Although distinct embodiments have been described, the skilled person will understand how features of different embodiments, including features described in co-pending application Ser. No. 11/975,808, may be combined.

What is claimed is:

1. A head-switchable cosmetic applicator, comprising:

a first assembly including a head for application of a cosmetic and a ferrule including a lower end defined at least in part by a first magnetic element; and a second assembly comprising:

a core having an upper end defined at least in part by a second magnetic element;

an outer body surrounding the core; and a slidable sleeve partly within the outer body;

wherein at least one of the first and second magnetic elements is a magnet, and the first assembly is releasably attachable to the second assembly by magnetic attraction between the first and second magnetic elements when the first assembly and the second assembly are attached;

wherein the lower end of the ferrule and the upper end of the core are generally planar; and wherein when the first assembly and the second assembly are attached the sleeve is slidable in a lengthways direction of the second assembly between an extended position in which it at least partly surrounds the head and a retracted position in which the head is exposed for use and in which the second magnetic element and at least a part of the ferrule including the first magnetic element are within the sleeve.

2. The head-switchable applicator according to claim 1, wherein the first and second magnetic elements are both permanent magnets, and are oriented so as to attract one another when the first assembly and the second assembly are assembled together.

3. The head-switchable applicator according to claim 1, wherein one of the first and second magnetic elements is a permanent magnet, and the other is magnetically soft.

4. The head-switchable applicator according to claim 1, further comprising at least one additional first assembly including a ferrule and a first magnetic element, and wherein the additional first assembly is releasably attachable to the second assembly by magnetic attraction between the first and second magnetic elements when the additional first assembly and the second assembly are attached.

5. The head-switchable applicator according to claim 1, further comprising a cap dimensioned to fit onto the sleeve over the head when the first assembly and the second assembly are attached.

6. The head-switchable applicator according to claim 5, wherein the cap is sufficiently long to fit over the head when the sleeve is retracted and the cap is fitted onto the sleeve until the cap engages a stop on the sleeve.

7. A handle for a head-switchable applicator, comprising:

a core having a generally planar end at least partly defined by a magnetic element;

a sleeve slidable with respect to the core when the core is maintained in a fixed position; and an outer body fixed relative to the core, wherein the outer body encloses the core, the magnetic element, and a part of the sleeve;

wherein the generally planar end of the core defines a floor of a cavity; and wherein sliding the sleeve from a retracted to an extended position increases the depth of the cavity.

8. A head-switchable cosmetic applicator, comprising:

a first assembly including a head for application of a cosmetic and a ferrule including a lower end defined at least in part by a first magnetic element; and a second assembly comprising:

a core including an upper end defined at least in part by a second magnetic element; and a slidable sleeve situated around the core;

wherein at least one of the first and second magnetic elements is a magnet, and the first assembly is releasably attachable to the second assembly by magnetic attraction between the first and second magnetic elements when the first assembly and the second assembly are attached; and wherein the lower end of the ferrule and the upper end of the core are generally planar;

wherein when the first assembly and the second assembly are attached the sleeve is slidable in a lengthways direction relative to the core between an extended position in which it at least partly surrounds the head and a retracted position in which the head is exposed for use and the sleeve at least partly surrounds the ferrule; and wherein in a fully retracted position a first protrusion on the slidable sleeve interacts with an outer body surrounding the core to limit additional retraction of the slidable sleeve relative to the core.

9. The head-switchable applicator according to claim 8, wherein in a fully extended position a lip on the slidable sleeve interacts with a second protrusion on the core to limit additional extension of the slidable sleeve relative to the core.

* * * * *